US006857398B2

(12) United States Patent
Takagi et al.

(10) Patent No.: US 6,857,398 B2
(45) Date of Patent: Feb. 22, 2005

(54) COOLING SYSTEM FOR INTERNAL COMBUSTION ENGINE

(75) Inventors: Isao Takagi, Okazaki (JP); Shigetaka Yoshikawa, Nishikamo-gun (JP); Yoshikazu Shinpo, Nissin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/349,932

(22) Filed: Jan. 24, 2003

(65) Prior Publication Data

US 2003/0150406 A1 Aug. 14, 2003

(30) Foreign Application Priority Data

Feb. 13, 2002 (JP) ..... 2002-034961

(51) Int. Cl.[7] ..... F01P 7/14
(52) U.S. Cl. ..... 123/41.1
(58) Field of Search ..... 123/41.1, 41.44

(56) References Cited

U.S. PATENT DOCUMENTS 5,390,632 A * 2/1995 Ikebe et al. ..... 123/41.1
5,724,924 A 3/1998 Michels
6,390,031 B1 * 5/2002 Suzuki et al. ..... 123/41.1

FOREIGN PATENT DOCUMENTS

| | | |
|---|---|---|
| DE | 199 33 794 | 2/2000 |
| EP | 0 965 737 | 12/1999 |
| JP | 5-179948 A | 7/1993 |
| WO | WO 01/75281 | 10/2001 |

* cited by examiner

*Primary Examiner*—Noah P. Kamen
(74) *Attorney, Agent, or Firm*—Kenyon & Kenyon

(57) ABSTRACT

A cooling system for an internal combustion engine includes a radiator provided in a coolant circulation path of the internal combustion engine, and an actuator that controls a flow rate of a coolant that passes through the radiator. In the cooling system, the actuator is controlled so that a coolant temperature of the engine becomes substantially equal to a target coolant temperature. The cooling system calculates a cooling loss as a quantity of heat removed from the engine by the coolant, based on an operating state of the engine, and calculates a required radiator flow rate, based on the cooling loss, the target coolant temperature, and a temperature of the coolant that has passed through the radiator. The required radiator flow rate represents a quantity of the coolant required to pass through the radiator so as to achieve the target coolant temperature. The cooling system then controls the actuator based on the required radiator flow rate.

24 Claims, 7 Drawing Sheets

COOLING SYSTEM FOR INTERNAL COMBUSTION ENGINE

INCORPORATION BY REFERENCE

The disclosure of Japanese Patent Application No. 2002-034961 filed on Feb. 13, 2002, including the specification, drawings and abstract, is incorporated herein by reference in its entirety.

BACKGROUND OF THE INVENTION

1. Field of the Invention

The invention relates to a cooling system adapted to cool an internal combustion engine by circulating a coolant and effecting heat exchange between the coolant and the internal combustion engine.

2. Description of Related Art

A known cooling system for a water-cooled engine installed on a motor vehicle, or the like, includes a radiator provided in a coolant circulation path of the engine for cooling a coolant or cooling water, and a flow control valve that controls the flow rate of the coolant that passes through the radiator. In this type of cooling system, the temperature of the engine coolant changes in accordance with the flow rate of the coolant that is controlled through control of the opening of the flow control valve.

One example of the control of the opening of the flow control valve is disclosed in, for example, Japanese Laid-open Patent Publication No. 5-179948. Under the valve opening control disclosed, a target coolant temperature is set based on the engine load and the engine speed. Then, the opening of the flow control valve is controlled in a feedback fashion so that the actual engine coolant temperature is made equal to the set target coolant temperature. With this control, the flow rate of the coolant passing through the radiator is controlled, and the engine coolant temperature approaches and becomes substantially equal to the target coolant temperature.

With the known technology as described above, the temperature of the coolant is controlled depending upon the load state or condition of the engine. When the engine is required to generate a high level of driving power, therefore, the coolant temperature is lowered so as to increase the cooling efficiency of cylinders of the engine. When the engine is required to operate with a low fuel consumption (i.e., at a high fuel efficiency), on the other hand, the coolant temperature is elevated so as to increase the combustion efficiency in the cylinders. In this manner, the coolant temperature is controlled so as to achieve sufficiently high levels in opposite performances or characteristics, i.e., high power (output performance) and low fuel consumption.

In the cooling system disclosed in the above-identified publication, control of the opening of the flow control valve is performed based only upon a difference between the actual coolant temperature and the target coolant temperature. Therefore, the cooling system suffers from poor response when controlling the coolant temperature to the target coolant temperature. In particular, when a quantity of heat equivalent to a cooling loss of the engine changes with a change in the operating state of the engine, the coolant temperature cannot be controlled to the target coolant temperature with good response. Here, the coolant loss is a quantity of heat removed from the engine and radiated or absorbed into the coolant in the process in which the coolant passes through the engine. If the coolant loss changes as described above, a power loss takes place which is detrimental to improvements in the fuel efficiency and the output performance. A similar problem may be encountered in a cooling system in which the flow rate of coolant passing through a radiator is controlled by an electric water pump, in place of the flow control valve.

SUMMARY OF THE INVENTION

It is therefore an object of the invention to provide a cooling system for an internal combustion engine, in which the coolant temperature of the internal combustion engine can be controlled to the target coolant temperature with improved response, even if the coolant loss changes with a change in the operating state of the internal combustion engine.

To accomplish the above object, there is provided according to one aspect of the invention a cooling system for an internal combustion engine, including a radiator provided in a coolant circulation path of the internal combustion engine, and an actuator that controls a flow rate of a coolant that passes through the radiator, wherein the actuator is controlled so that a coolant temperature of the internal combustion engine becomes substantially equal to a target coolant temperature, comprising: (a) a calculating unit that calculates a cooling loss as a quantity of heat removed from the internal combustion engine and received by the coolant, based on an operating state of the internal combustion engine, and calculates a required radiator flow rate, based on the cooling loss, the target coolant temperature, and a temperature of the coolant that has passed through the radiator, the required radiator flow rate representing a quantity of the coolant required to pass through the radiator so as to make the coolant temperature substantially equal to the target coolant temperature; and (b) a control unit that controls the actuator based on the required radiator flow rate obtained by the calculating unit.

In the cooling system constructed as described above, the calculating unit calculates the quantity of heat equivalent to the cooling loss of the internal combustion engine, namely, the quantity of heat removed by the coolant in the process in which the coolant passes through the internal combustion engine, based on the operating state of the engine. Also, the required radiator flow rate, namely, the quantity of the coolant required to pass through the radiator so as to achieve the target coolant temperature is calculated based on the cooling loss, the target coolant temperature and the temperature of the coolant that has passed through the radiator. The control unit of the system controls the actuator based on the required radiator flow rate obtained by the calculating unit. With this control, the flow rate of the coolant passing through the radiator is suitably controlled so that the coolant temperature of the internal combustion engine approaches and becomes substantially equal to the target coolant temperature.

Accordingly, even if the cooling loss (i.e., the quantity of heat equivalent to the cooling loss) changes with a change in the operating state of the engine, the actuator is controlled in accordance with the change of the cooling loss. Therefore, the coolant temperature of the engine can be controlled to the target coolant temperature with good response.

In the cooling system according to the above aspect of the invention, the operating state of the internal combustion engine used for calculating the cooling loss includes at least one of a speed of revolution of the internal combustion engine and an engine load. In this case, the cooling loss can be determined with high accuracy.

Furthermore, in the cooling system as described above, the control unit may calculate a command opening based on the required radiator flow rate obtained by the calculating unit and the operating state of the internal combustion engine, and an opening of the actuator may be controlled according to the command opening.

In the above case, the command opening of the actuator is determined based on the required radiator flow rate obtained by the calculating unit and the operating state of the internal combustion engine. If the opening of the actuator is controlled in accordance with the command opening thus determined, the flow rate of the coolant passing through the radiator is suitably controlled, so that the coolant temperature of the internal combustion engine is smoothly controlled to the target coolant temperature.

In one embodiment of the above aspect of the invention, the calculating unit further calculates a received/radiated heat quantity of at least one heat receiving/radiating circuit that is provided in the coolant circulation path and bypasses the radiator, and calculates the required radiator flow rate based on the received/radiated heat quantity in addition to the cooling loss, the target coolant temperature and the temperature of the coolant that has passed through the radiator.

In the above arrangement in which the heat receiving/radiating circuit(s) bypassing the radiator is provided, the coolant receives or radiates heat while passing through the heat receiving/radiating circuit(s). The coolant which has received or radiated heat flows into the coolant circulation path, and passes through the internal combustion engine again.

According to the above-described embodiment, the required radiator flow rate is calculated based on the quantity of heat received or radiated in the heat receiving/radiating circuit(s), in addition to the cooling loss, target coolant temperature, and the temperature of the coolant that has passed through the radiator. Then, the control unit controls the actuator based on the required radiator flow rate obtained by the calculating unit.

Accordingly, the coolant temperature is smoothly controlled to the target coolant temperature at an increased speed with improved accuracy, even when the quantity of heat received or radiated in the heat receiving/radiating circuit(s) changes. Namely, the degree of overshoot or undershoot in the coolant temperature control can be reduced, and therefore the target coolant temperature need not be lowered in view of the heat resistance of components that constitute the internal combustion engine. In this specification, the overshoot means a phenomenon where the coolant temperature exceeds the target coolant temperature after reaching the target level, and the undershoot means a phenomenon where the coolant temperature falls below the target cooling temperature after being lowered down to the target level. Since the target cooling temperature need not be lowered as described above, it is possible to avoid or suppress friction increases in the engine and automatic transmission due to the otherwise possible reduction of the target cooling temperature, and thereby avoid or suppress deterioration of the fuel efficiency (i.e., an increase of the fuel consumption).

In the cooling system as described just above, the above-indicated at least one heat receiving/radiating circuit may consist of a plurality of heat receiving/radiating circuits, and the calculating unit may calculate the received/radiated heat quantity of the heat receiving/radiating circuits based on a junction flow rate measured at a meeting portion of the heat receiving/radiating circuits, a junction coolant temperature measured at the meeting portion, and the coolant temperature of the internal combustion engine. Thus, the received/radiated heat quantity can be determined with improved accuracy by using the flow rate and temperature of the coolant in the meeting portion, as parameters that influence the received/radiated heat quantity in the heat receiving/radiating circuits.

In another embodiment of the invention the calculating unit further calculates a quantity of heat radiated from a main body of the internal combustion engine, and calculates the required radiator flow rate based on the quantity of heat radiated from the engine body in addition to the cooling loss, the target coolant temperature and the temperature of the coolant that has passed through the radiator.

The cooling loss is supposed to vary with a change in the quantity of heat radiated from the main body of the internal combustion engine (which quantity will be called "engine body radiated heat quantity"), as well as a change in the operating state of the internal combustion engine. According to this embodiment, therefore, the engine body radiated heat quantity is calculated, and the calculated heat quantity is reflected in the calculation of the radiator flow rate. Accordingly, even if the engine body radiated heat quantity changes, the coolant temperature is more smoothly and accurately controlled to the target coolant temperature. Namely, the degree of overshoot or undershoot in the coolant temperature control can be reduced, and therefore the target coolant temperature need not be lowered in view of the heat resistance of components that constitute the internal combustion engine. This arrangement makes it possible to avoid or suppress friction increases in the engine and automatic transmission due to the otherwise possible reduction of the target cooling temperature, and thereby avoid or suppress deterioration of the fuel efficiency (i.e., an increase of the fuel consumption).

In the cooling system as described just above, the internal combustion engine may be installed on a vehicle, and the calculating unit may calculate the engine body radiated heat quantity based on at least one of a running speed of the vehicle and an ambient temperature around the vehicle. Thus, the engine body radiated heat quantity can be determined with improved accuracy, by using at least one of the running speed of the vehicle and the ambient temperature, as parameters that influence the quantity of heat radiated from the engine body.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF THE EXEMPLARY EMBODIMENTS

First Embodiment

A first embodiment of the invention will be described in detail with reference to FIG. 1 through FIG. 4.

Figure 1:
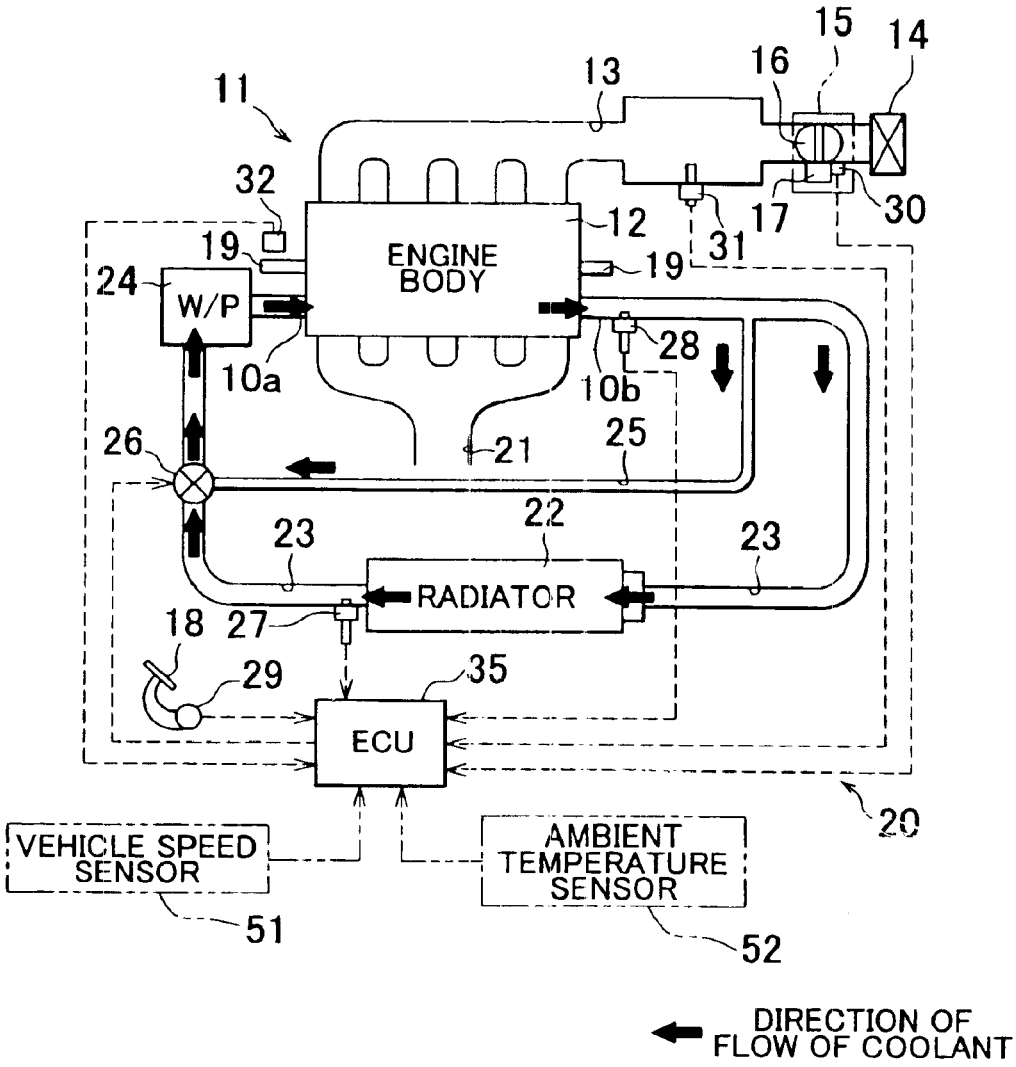
FIG. 1 is a schematic view showing the construction of a cooling system of an internal combustion engine according to a first embodiment of the invention.

As shown in FIG. 1, a principal part of a multi-cylinder engine installed on a motor vehicle consists of an engine body 12 including a cylinder block, a cylinder head and other components. To the engine body 12 is connected an intake passage 13 through which the air is introduced into a combustion chamber of each cylinder. The intake passage 13 is provided with an air cleaner 14 and a throttle body 15. The air cleaner 14 is a filter that traps and removes dust in the air introduced into the engine body 12. A throttle valve 16 is rotatably supported in the throttle body 15, and a throttle motor 17 for driving the throttle valve 16 is operatively coupled to the throttle valve 16.

An electronic control unit (ECU) 35 controls the throttle motor 17 as described later, based on an operation of the driver to depress an accelerator pedal 18 and other parameters, so as to rotate the throttle valve 16. The intake air quantity, which is the amount of the air flowing through the intake passage 13, changes in accordance with the throttle opening (i.e., the angle of rotation of the throttle valve 16). In the combustion chamber of each cylinder, a mixture of a fuel and the air fed to the chamber through the intake passage 13 is burned. A part of the heat energy generated upon combustion of the air-fuel mixture is converted to power for rotating a crankshaft 19 as an output shaft of the engine. To the engine body 12 is also connected an exhaust passage 21 through which combustion gas produced in the combustion chamber is discharged to the outside of the engine 11. Another part of the heat energy, which is not converted into power, may be lost in the form of a friction loss, and the remaining part of the heat energy is absorbed by various portions of the engine body 12. A water-cooling type cooling system 20 as described below is provided for preventing the thus absorbed heat absorbed by the engine body 12 from overheating the engine body 12.

A water jacket (not shown), serving as a passage for a coolant or cooling water, is disposed in the inside of the engine body 12. A radiator 22 is connected to inlet 10*a* and outlet 10*b* of the water jacket via a radiator passage 23.

A water pump (W/P) 24 is mounted at or in the vicinity of the inlet 10*a* of the water jacket. The water pump 24 is operatively coupled to the crankshaft 19 by means of a pulley, a belt and the like, and is adapted to operate by utilizing rotation of the crankshaft 19 resulting from an operation of the engine 11. The water pump 24 sucks up or pumps up the coolant and delivers it into the water jacket. Owing to the suction and delivery of the water pump 24, the coolant is circulated from the water pump 24 at the beginning point to pass through the radiator passage 23 in the clockwise direction of FIG. 1 (as indicated by arrows in FIG. 1). During the circulation, the temperature of the coolant is elevated as the coolant absorbs the heat of the engine body 12 while passing through the water jacket. The heat of the coolant thus heated is radiated while passing through the radiator 22.

A bypass passage 25 that bypasses the radiator 22 is connected to the radiator passage 23. More specifically, one end (the right-side end in FIG. 1) of the bypass passage 25 is connected to a certain point of the radiator passage 23 between the radiator 22 and the outlet 10*b* of the water jacket. The other end (the left-side end in FIG. 1) of the bypass passage 25 is connected to a certain point of the radiator passage 23 between the radiator 22 and the water pump 24. Thus, the water jacket as described above, radiator passage 23, bypass passage 25 and others cooperate to form a coolant circulation path.

A flow control valve 26, which serves as an actuator for controlling the flow rate of the coolant, is provided at a joint point at which the above-indicated other end of the bypass passage 25 is connected to the radiator passage 23. The flow control valve 26 is operable to control its valve opening so as to control the flow rate of the coolant flowing through the radiator passage 23 and the bypass passage 25. In this embodiment, the flow control valve 26 is constructed such that the flow rate of the coolant flowing through the radiator passage 23 increases as the valve opening increases.

In operation, the flow control valve 26 controls the flow rate of the coolant in the radiator passage 23, thereby to control the temperature of the coolant for cooling the engine body 12. More specifically, if the flow rate of the coolant in the radiator passage 23 increases, the proportion of the coolant cooled by the radiator 22 to the coolant that flows toward the engine body 12 in the coolant circulation path is increased, whereby the temperature of the coolant for cooling the engine body 12 is lowered. If the flow rate of the coolant in the radiator passage 23 decreases, on the other hand, the proportion of the coolant cooled by the radiator 22 to the coolant that flows toward the engine body 12 in the coolant circulation path is reduced, whereby the temperature of the coolant for cooling the engine body 12 is increased.

Various kinds of sensors for detecting the operating conditions of the vehicle are mounted in the vehicle. For example, the radiator 22 is equipped with a radiator outlet water temperature sensor 27 for measuring the temperature (i.e., radiator outlet water temperature T2) of the coolant that has just passed the radiator 22. The engine body 12 is provided with an engine outlet water temperature sensor 28 for measuring the temperature (i.e., engine outlet water temperature To) of the coolant that has just passed the outlet 10*b* of the water jacket, as the coolant temperature of the engine body 12. Also, an accelerator pedal sensor 29 for measuring an amount of depression of an accelerator pedal 18 by the driver (or accelerator pedal position) is mounted at or in the vicinity of the accelerator pedal 18. The throttle body 15 is provided with a throttle sensor 30 for measuring the throttle opening. An intake pressure sensor 31 for measuring the pressure of the intake air (i.e., intake pressure) is mounted in a portion of the intake passage 13 located downstream of the throttle valve 16. A crank angle sensor 32 is provided in the vicinity of the crankshaft 19. The crank angle sensor 32 is adapted to generate a pulse signal each time the crankshaft 19 rotates by a predetermined angle. The signal generated by the crank angle sensor 32 is used for calculating the angle and speed of rotation of the crankshaft 19, i.e., the crank angle and the engine speed NE.

The ECU 35 as indicated above is used in the vehicle for controlling respective parts of the engine 11 based on measurement values of the above-indicated sensors 27–32. The ECU 35 has a microcomputer as a main component, and its central processing unit (CPU) performs arithmetic operations according to control programs, initial data, maps and the like stored in a read-only memory (ROM), so as to carry out various controls based on the results of the arithmetic operations. The calculation results obtained by the CPU are temporarily stored in a random access memory (RAM).

Figure 2:
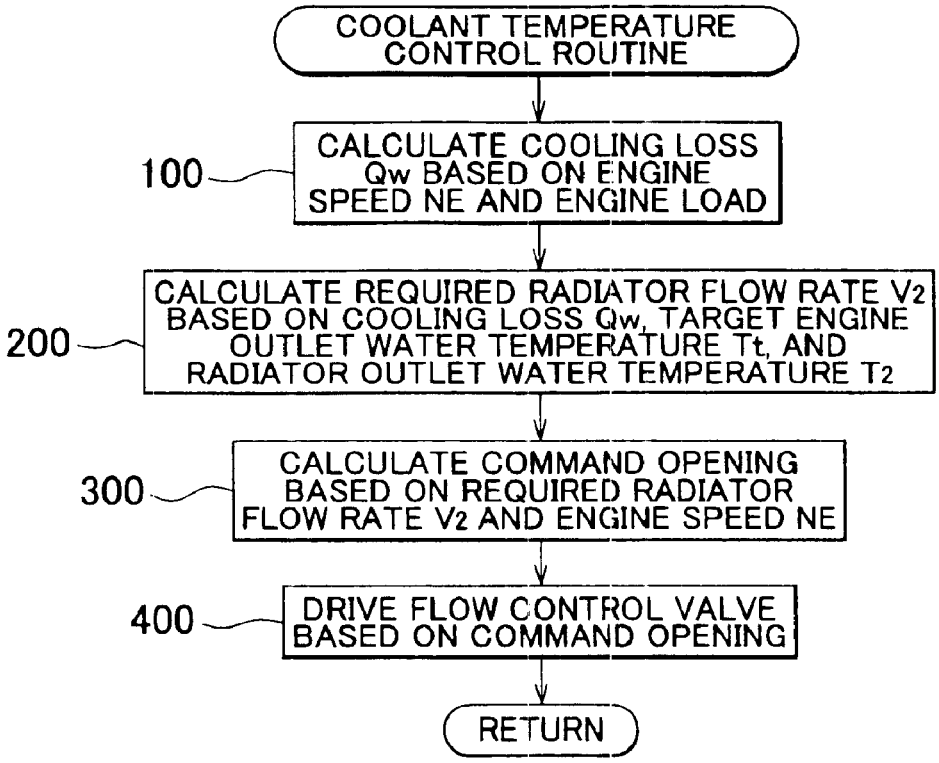
FIG. 2 is a flowchart showing a control routine for controlling the temperature of coolant.

Next, the operation of the first embodiment constructed as described above will be explained. FIG. 2 is a flowchart showing a control routine, as one of control routines executed by the ECU 35, for controlling the coolant temperature (engine outlet water temperature To) of the engine body 12 through control of the opening of the flow control valve 26. The routine of FIG. 2 is executed at appropriate times, for example, at predetermined time intervals.

Figure 3:
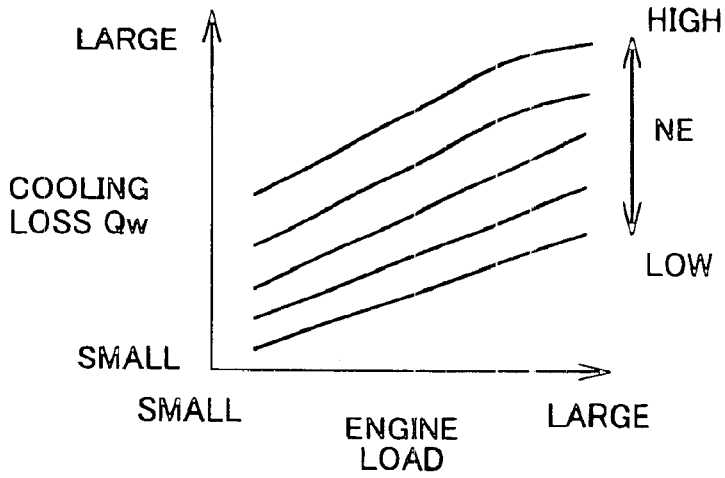
FIG. 3 is a schematic view showing a map used for determination of the quantity of heat equivalent to cooling loss.

Initially, step S100 is executed to calculate a quantity of heat transferred to the coolant (hereinafter simply referred to as "cooling loss") Qw. This calculation is performed referring to a map as shown in FIG. 3 by way of example, which preliminarily defines a relationship between the engine speed NE and the engine load (or engine load factor), and the cooling loss Qw. The load factor is a value indicative of the rate or proportion of the current load to the maximum load of the engine 11. The map of FIG. 3 is prepared with respect to each engine outlet water temperature To. As is understood from the map, the cooling loss Qw is relatively small when the engine speed NE is relatively low, and is increased as the engine speed NE increases. This is because the quantity of heat generated in the engine body 12 increases as the quantity of fuel supplied to the combustion chamber per unit time increases with an increase in the engine speed NE, and therefore the quantity of heat lost by the coolant in the engine body 12 is accordingly increased. A map having a similar tendency to the map of FIG. 3 is used when the engine load factor is used in place of the engine load.

The cooling loss Qw is relatively small when the engine load is relatively small, and is increased as the engine load increases. It is, however, to be noted that in a region in which the engine speed NE is relatively high, the rate of increase of the cooling loss Qw with an increase in the engine load is relatively small. This is because the fuel supplied to the combustion chamber per unit time increases with an increase in the engine speed NE as described above, and the temperature of the combustion chamber is lowered due to the cooling effect resulting from the increase in the quantity of fuel, whereby the quantity of heat removed by the coolant in the engine body 12 is reduced.

The cooling loss Qw basically depends upon the quantity of heat generated in the engine body 12. In this context, an element relating to the quantity of heat generated, for example, a fuel injection quantity per combustion cycle, intake air quantity, or the like, may be used as the engine load. The intake air quantity is considered as an element that indirectly relates to the quantity of heat generated, because the fuel is injected in an amount corresponding to the intake air quantity under fuel injection control. Other than the fuel injection quantity and the intake air quantity, an intake pressure measured by the intake pressure sensor 31, a throttle opening measured by the throttle sensor 30, or the like, may also be used as the engine load. In this case, however, it is desirable to make corrections as needed.

In step S100, the ECU 35 determines the coolant loss Qw corresponding to the engine speed NE measured by the crank angle sensor 32 and the engine load, from the map of FIG. 3.

In step S200, the required radiator flow rate V2 is calculated according to the following expression (1), based on the cooling loss Qw, target engine outlet water temperature Tt, and the radiator outlet water temperature T2 measured by the radiator outlet water temperature sensor 27. The required radiator flow rate V2 is the flow rate of the coolant in the radiator 22 which is required for making the engine outlet water temperature To equal to the target engine outlet water temperature Tt.

$$V2=Qw/\{C\cdot(Tt-T2)\} \quad (1)$$

In the above expression (1), C is a coefficient for converting temperature to flow rate, which coefficient is determined, for example, by a product of the specific heat and density of the coolant. The target engine outlet water temperature Tt is determined depending upon the operating state of the engine 11. For example, when the operating state of the engine is in an idle region, the target engine outlet water temperature Tt is set to a slightly low temperature (e.g., 90° C.) so as to avoid or suppress knocking upon a start of the vehicle, for example. When the operating state of the engine is in a partial load region, the target engine outlet water temperature Tt is set to a relatively high temperature (e.g., 100° C.) so as to reduce friction loss, for example. When the engine operating state is in a full load region, the target engine outlet water temperature Tt is set to a relatively low temperature (e.g., 80° C.) so as to increase the charging efficiency. It is to be understood that the above values of the target engine outlet water temperature Tt are merely exemplary, and may be changed as needed.

Figure 4:
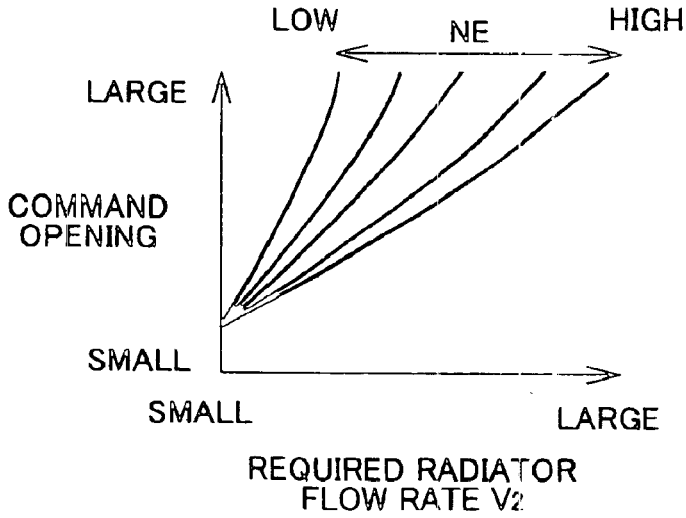
FIG. 4 is a schematic view showing a map used for determination of the command opening.

Subsequently, in step S300, a command opening to be sent to the flow control valve 26 is calculated based on the required radiator flow rate V2 obtained in step S200 and the engine speed NE. This calculation is performed with reference to a map as shown in FIG. 4 by way of example, which defines a relationship between the required radiator flow rate V2 and engine speed NE, and the command opening. In the map of FIG. 4, the command opening decreases as the required radiator flow rate V2 decreases, and increases as the required radiator flow rate V2 increases. Also, when the engine speed NE is relatively small, the command opening changes to a large extent even if the required radiator flow rate V2 slightly changes. On the other hand, as the engine speed NE increases, the rate of change of the command opening with an increase in the required radiator flow rate V2 decreases, namely, the command opening does not change so much unless the required radiator flow rate V2 largely changes.

In step S300, the ECU 35 determines the command opening corresponding to the required radiator flow rate V and the engine speed NE, from the map of FIG. 4.

In the next step S400, the valve opening is changed by driving the flow control valve 26 under control based on the command opening determined in step S300. After the operation of step S400 is finished, the coolant temperature control routine of FIG. 2 is terminated. By controlling the opening of the flow control valve 26, the flow rate of the coolant passing through the radiator 22 is controlled, and the engine outlet water temperature To is made substantially equal to the target engine outlet water temperature Tt.

The present embodiment as described above in detail provides the following advantageous effects.

(a) The control of the opening of the flow control valve 26 reflects the engine load. Therefore, the engine outlet water temperature To can be controlled to the target engine outlet water temperature Tt suitable for the current engine load (i.e., the engine load at the time of control), unlike the case where the valve opening is controlled based only on the coolant temperature. For example, when the vehicle runs with high power, the engine outlet water temperature To is reduced so as to increase the cooling efficiency of each cylinder. When the vehicle runs with a relatively low fuel consumption, the engine outlet water temperature To is increased so as to improve the combustion efficiency within the cylinders. Thus, the engine performance can be improved by satisfying opposite requirements for high output (i.e., power) and low fuel consumption.

(b) The cooling loss Qw is calculated (in step S100) by using the engine speed NE and the engine load as parameters representing the engine operating state. Thus, the cooling loss Qw can be calculated with high accuracy, based on the engine speed NE and the engine load that influence the cooling loss Qw. Furthermore, since the cooling loss Qw is calculated based on both the engine speed NE and the engine load, the accuracy of calculation of the cooling loss Qw can be improved as compared with the case where the same quantity Qw is calculated based on only one of the engine speed NE and the engine load.

(c) The cooling loss Qw is calculated based on the operating state of the engine 11 (in step S100), and the resulting cooling loss Qw is reflected in the calculation of the required radiator flow rate V2 (in step S200). Therefore, even in the case where the cooling loss Qw changes with a change in the operating state of the engine 11, the opening of the flow control valve 26 can be controlled in accordance with the change of the cooling loss Qw, so that the engine outlet water quantity To can be controlled to the target engine outlet water temperature Tt with good response. In the known technology as discussed above, the opening of the flow control valve is controlled in a feedback fashion based only on a deviation of the coolant temperature from the target coolant temperature, which makes it difficult to provide such a good response. Thus, in the first embodiment, the engine outlet water temperature To can be lowered in a relatively short time when the vehicle is placed in a high power running mode, and can also be elevated in a relatively short time when the vehicle is placed in a low-fuel-consumption running mode, thus making it possible to reduce losses which would otherwise occur in the high power running mode and the low-fuel-consumption mode.

(d) If the command opening of the flow control valve 26 is directly determined from the operating state of the engine 11, or the like, and the opening of the flow control valve 26 is controlled in accordance with the command opening thus determined, the command opening needs to be determined again when a flow control valve having a different flow property is used, resulting in reduced applicability of the system. In the first embodiment, on the other hand, the required radiator flow rate V2 corresponding to the radiator outlet water temperature T2 is once determined, and the command opening of the flow control valve 26 is determined from the required radiator flow rate V2. Therefore, even in the case where a flow control valve having a different flow property is used, there is no need to determine a command opening corresponding to the flow property with respect to each type of flow control valve.

Second Embodiment

Next, a second embodiment of the invention will be described in detail with reference to FIG. 5 through FIG. 7. In the second embodiment, a plurality of heat receiving/radiating circuits that bypass the radiator 22 are provided in addition to the bypass passage 25. With this arrangement, the quantity of heat received or radiated in each of the heat receiving/radiating circuits is calculated, and the obtained quantity of heat is reflected in the calculation of the required radiator flow rate V2. The second embodiment is mainly different from the first embodiment in these respects. These differences will be now explained in detail.

Figure 5:
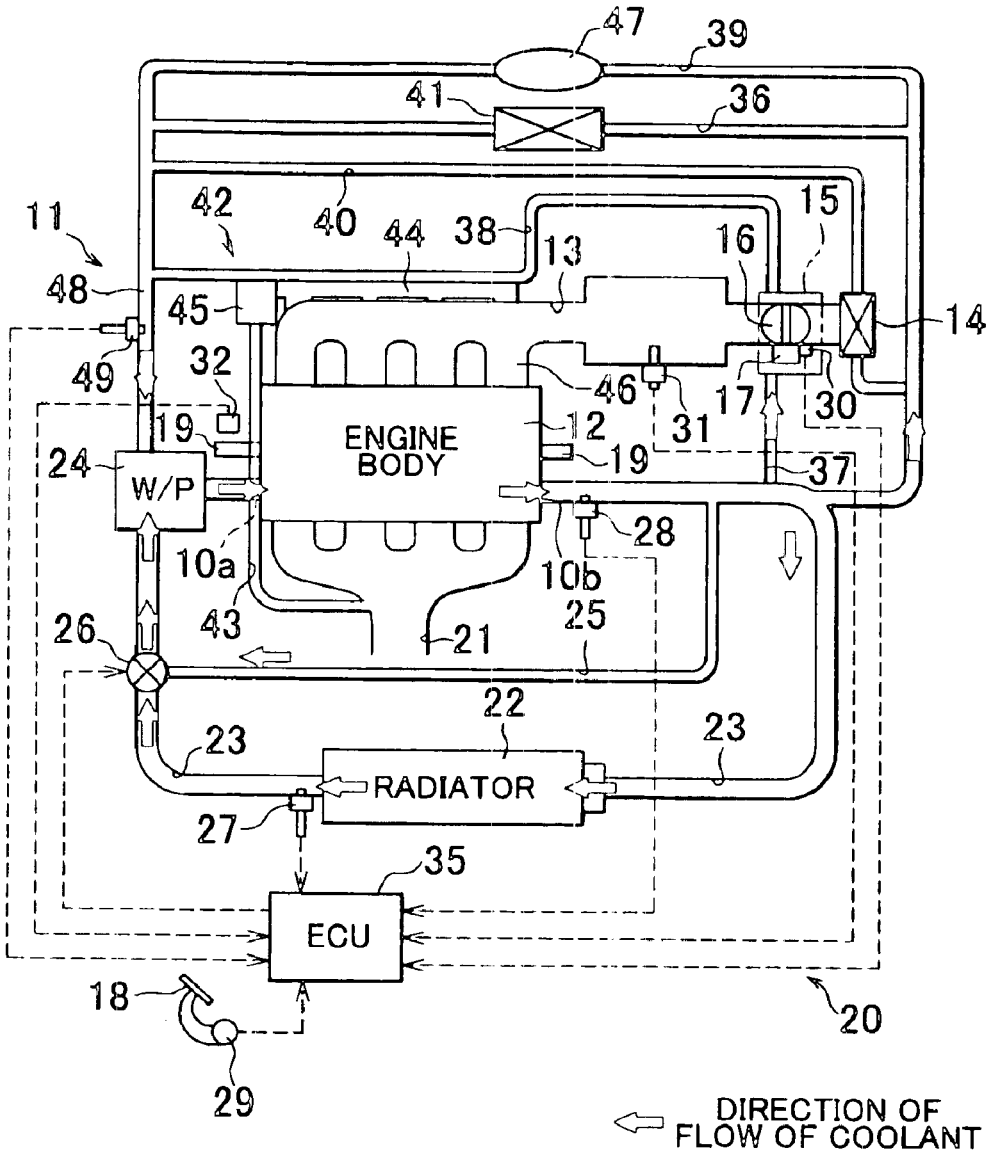
FIG. 5 is a schematic view showing the construction of a cooling system of an internal combustion engine according to a second embodiment of the invention.
Figure 6:
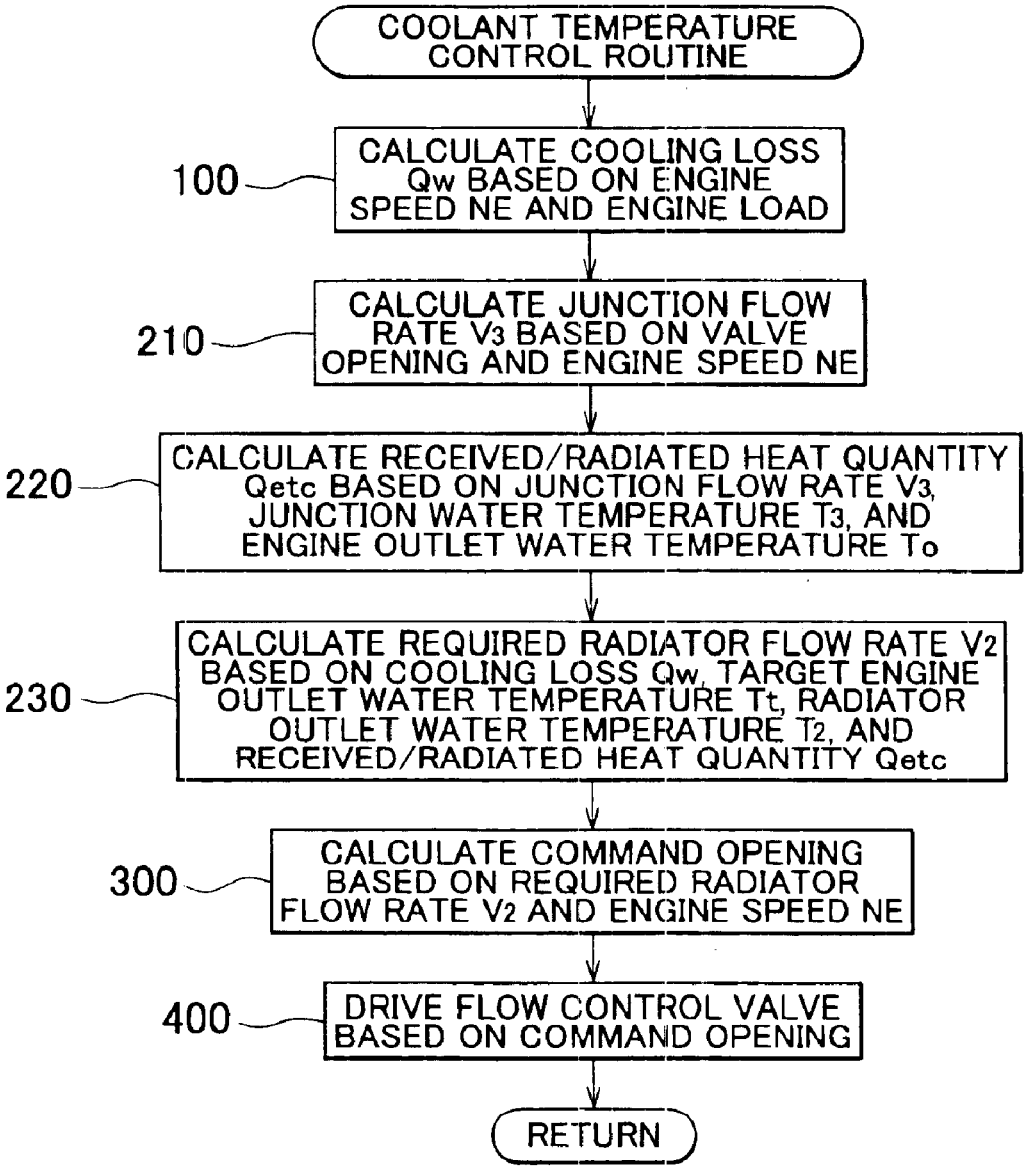
FIG. 6 is a flowchart showing a control routine for controlling the temperature of coolant.

In the second embodiment, a heater circuit 36, a throttle body hot water circuit 37, an EGR cooler circuit 38, a hydraulic oil warmer (transmission oil cooler) circuit 39 for an automatic transmission, and a hot air intake circuit 40 of hot water heating type are provided as heat receiving/radiating circuits, as shown in FIG. 5. The heater circuit 36 is connected to a heater core (i.e., heat exchange device) 41 of a hot water type heater (heating device), and the coolant that flows through the heater circuit 36 is fed as a heat source to the heater core 41. The throttle body hot water circuit 37 is connected to the throttle body 15, and the throttle body 15 is warmed in the process in which the coolant (hot water) flows through the hot water circuit 37. With the throttle body 15 thus warmed, the operation of the throttle valve 16, or the like, is stabilized in an extremely cold environment, for example.

A part of the EGR cooler circuit 38 is disposed along an EGR system 42. The EGR system 42 serves as a means for reducing nitrogen oxides contained in exhaust gas, and operates to return a portion of the exhaust gas to the intake passage 13, for the purposes of lowering the maximum temperature at which the air-fuel mixture is burned, and thereby reducing the amount of nitrogen oxides produced by the engine. The EGR system 42 includes an EGR passage 43 that connects the exhaust passage 21 with the intake passage 13. The EGR passage 43 is provided at its downstream side with an EGR chamber 44 for uniformly supplying the EGR gas to the respective cylinders. Also, an EGR valve 45 is provided in the EGR passage 43 for controlling the flow rate of the EGR gas flowing through the EGR passage 43. In this arrangement, the EGR chamber 44, EGR valve 45 and the intake passage 13 (in particular, intake manifold 46) are cooled by the coolant flowing through the EGR cooler circuit 38.

In the present embodiment, the EGR cooler circuit 38 is connected to the downstream end of the throttle body hot water circuit 37. In other words, the circuits 38, 37 are connected in series. This arrangement may be replaced by another arrangement in which the EGR cooler circuit 38 is provided in parallel with the throttle body hot water circuit 37.

The hydraulic oil warmer circuit 39 is connected to a hydraulic oil warmer 47 for the automatic transmission. When a coolant (hot water) is caused to flow through the hydraulic oil warmer 47, the hydraulic oil of the automatic transmission is warmed in a short time upon a cold start of the engine, which leads to a reduction of the friction in the automatic transmission. The hydraulic oil warmer 47 also functions as an oil cooler when the temperature of the hydraulic oil is high. The hot air intake circuit 40 is connected to the air cleaner 14. With this arrangement, the intake air is warmed in the process in which the coolant passes a heater core provided in the vicinity of the air cleaner 14.

The upstream portion of each of the heat receiving/radiating circuits as described above is connected to a certain point of the radiator passage 23 between the outlet **10*b* of the water jacket and the radiator 22. Also, the downstream portions of these heat receiving/radiating circuits join or merge together into a meeting portion 48, which is in turn connected to the water pump 24. A junction water temperature sensor 49 for measuring the temperature of the coolant in the meeting portion 48 as a junction water temperature T3 is provided at or in the vicinity of the meeting portion 48 of the heat receiving/radiating circuits. The junction water temperature sensor 49 is connected to the ECU 35, as is the case with the other sensors 27–32**.

The construction of the cooling system 20 of the second embodiment is different from that of the first embodiment, and therefore the processing by the ECU 35 of the second embodiment is different from that of the first embodiment. In the following, a coolant temperature control routine to be executed by the ECU 35 will be described referring to the flowchart of FIG. 6. This coolant temperature control routine is different from that of the first embodiment with respect to an operation to calculate the required radiator flow rate V2. Since the other operations of the routine of FIG. 6 are substantially the same as those of the first embodiment, the same step numbers are assigned to these operations, of which no detailed explanation will be provided.

After the ECU 35 calculates the coolant loss Qw in step S100, the ECU 35 calculates the received/radiated heat quantity Qetc, i.e., the quantity of heat received or radiated in all of the heat receiving/radiating circuits, is calculated in steps S210–S220. Initially, in step S210, the flow rate of the coolant in the meeting portion 48 is calculated as a junction flow rate V3. This calculation is performed with reference to, for example, a map as shown in FIG. 7, which defines a relationship among the valve opening of the flow control valve 26, engine speed NE and the junction flow rate V3. As is understood from the map of FIG. 7, where the valve opening is in a relatively small range, the junction flow rate V3 is slightly reduced at a low rate as the valve opening increases. Where the valve opening is in a medium or large range, the junction flow rate V3 is substantially constant with no regard to the valve opening. Also, the junction flow rate V3 is relatively small when the engine speed NE is relatively low, and increases as the engine speed NE increases. The valve opening used herein may be the command opening used in the last control cycle.

Figure 7:
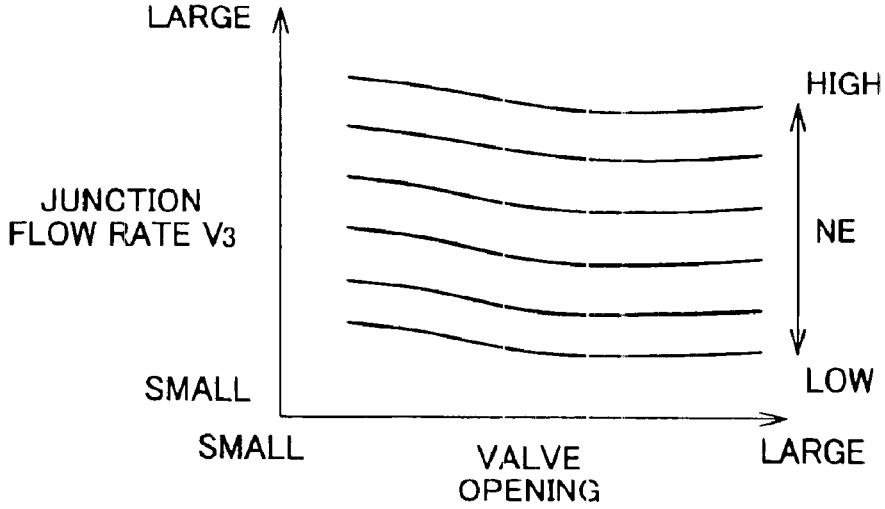
FIG. 7 is a schematic view showing a map used for determination of the flow rate of coolant in a meeting portion where heat receiving/radiating circuits that bypass the radiator merge into a single path.

In step S210 as described above, the ECU 35 determines the junction flow rate V3 corresponding to the valve opening and the engine speed NE, from the map of FIG. 7 by way of example.

In the next step S220, the received/radiated heat quantity Qetc in all of the heat receiving/radiating circuits is calculated according to the following expression (2), based on the junction flow rate V3 obtained in step S210, the junction water temperature T3 measured by the junction water temperature sensor 49, and the engine outlet water temperature To measured by the engine outlet water temperature sensor 28.

$$Qetc=C\cdot V3\cdot(To-T3) \tag{2}$$

In the expression (2), C is a coefficient that is the same as C in the above-indicated expression (1).

In the next step S230, the required radiator flow rate V2 is calculated according to the following expression (1a), based on the coefficient C, target engine outlet water temperature Tt, radiator outlet water temperature T2 measured by the radiator outlet water temperature sensor 27, cooling loss Qw, and the received/radiated heat quantity Qetc.

$$V2=(Qw-Qetc)/\{C\cdot(Tt-T2)\} \tag{1a}$$

In the above expression (1a), the definitions of C, Tt, T2 and Qw are the same as those of the same parameters used in the above-indicated expression (1).

After step S230 is executed, steps S300 and S400 similar to those of FIG. 2 are executed, and the cooling water control routine is terminated.

The second embodiment as described above in detail yields the following effects in addition to the above-described effects (a) to (d).

(e) With various heat receiving/radiating circuits that bypass the radiator 22 thus provided, heat is received or radiated (in other words, incoming and outgoing radiation of heat takes place) in the process in which the coolant passes through these heat receiving/radiating circuits. The coolant which has been subjected to the incoming and outgoing radiation of heat flows into the radiator passage 23 through the water pump 24, and passes through the water jacket in the engine body 12 again. If a large quantity of heat is received or radiated in the heat receiving/radiating circuits, the engine outlet water temperature To is controlled to a target value (i.e., target engine outlet water temperature Tt) at a reduced speed with a reduced accuracy unless the received/radiated heat quantity is taken into consideration, which may result in an increased degree of overshoot or undershoot in the cooling water temperature control.

The overshoot as mentioned above is a phenomenon where the engine outlet water temperature To cannot be maintained at the target engine outlet water temperature Tt after reaching the target engine outlet water temperature Tt, but further increases above (i.e., exceeds) the target value Tt. On the other hand, the undershoot as mentioned above is a phenomenon where the engine outlet water temperature To cannot be maintained at the target engine outlet water temperature Tt after being reduced down to the target engine outlet water temperature Tt, but further falls below the target value Tt.

In the case where the degrees of the overshoot or undershoot as described above are likely to be large, the target engine outlet water temperature Tt needs to be lowered in order to ensure normal operations of respective components of the engine body 12 and others in view of the heat resistance thereof. If the target engine outlet water temperature Tt is lowered, however, the engine outlet water temperature To is lowered, which may result in increased friction in the engine 11 and the automatic transmission, and reduced fuel efficiency (or increased fuel consumption).

In the second embodiment of the invention, the received/radiated heat quantity Qetc of the heat receiving/radiating circuits is calculated, and the thus obtained heat quantity Qetc is reflected in the calculation of the required radiator flow rate V2. More specifically, the required radiator flow rate V2 is calculated according to the above expression (1a) obtained by modifying the numerator of the above-indicated expression (1).

Accordingly, the engine outlet water temperature T0 is smoothly controlled to the target engine outlet water temperature Tt at an increased speed with an improved accuracy even if the received/radiated heat quantity of the heat receiving/radiating circuits changes. Namely, the degrees of the overshoot and the undershoot in the coolant temperature control can be reduced, and therefore the target engine outlet water temperature Tt need not be lowered in view of the heat resistance of the respective components of the engine body 12 and others. Consequently, the friction in the engine 11 and the automatic transmission will not be increased due to the otherwise possible reduction of the target engine outlet temperature Tt, and the fuel consumption will not be increased due to the otherwise possible friction increases.

(f) In connection with the effect (e) as described above, it is to be noted that the received/radiated heat quantity Qetc in the heat receiving/radiating circuit is relatively small if a difference between the junction water temperature T3 and the engine outlet water temperature To is small, and the received/radiated heat quantity Qetc is large if the temperature difference is large. Also, the received/radiated heat quantity Qetc is small if the junction flow rate V3 is small, and the received/radiated heat quantity Qetc increases as the junction flow rate V3 increases.

In the second embodiment of the invention, the received/radiated heat quantity Qetc in all of the heat receiving/radiating circuits is calculated according to the above-indicated expression (2), from the junction flow rate V3, junction water temperature T3 and the engine outlet water temperature To. Thus, the received/radiated heat quantity is calculated with improved accuracy by using the junction flow rate V3, junction water temperature T3 and the engine outlet water temperature To, i.e., parameters that influence the received/radiated heat quantity Qetc in the heat receiving/radiating circuits as described above.

Third Embodiment

Next, a third embodiment of the invention will be described with reference to FIG. 1 and FIGS. 8–10. In the third embodiment, a vehicle speed sensor 51 for measuring the vehicle speed SPD as a running speed of the vehicle and an ambient temperature sensor 52 for measuring the ambient air temperature THA are added to the system for detecting the operating state of the vehicle, as indicated by two-dot chain lines in FIG. 1. With the sensors 51, 52 thus added, the processing performed by the ECU 35 in the third embodiment is different from that of the first embodiment.

Figure 10:
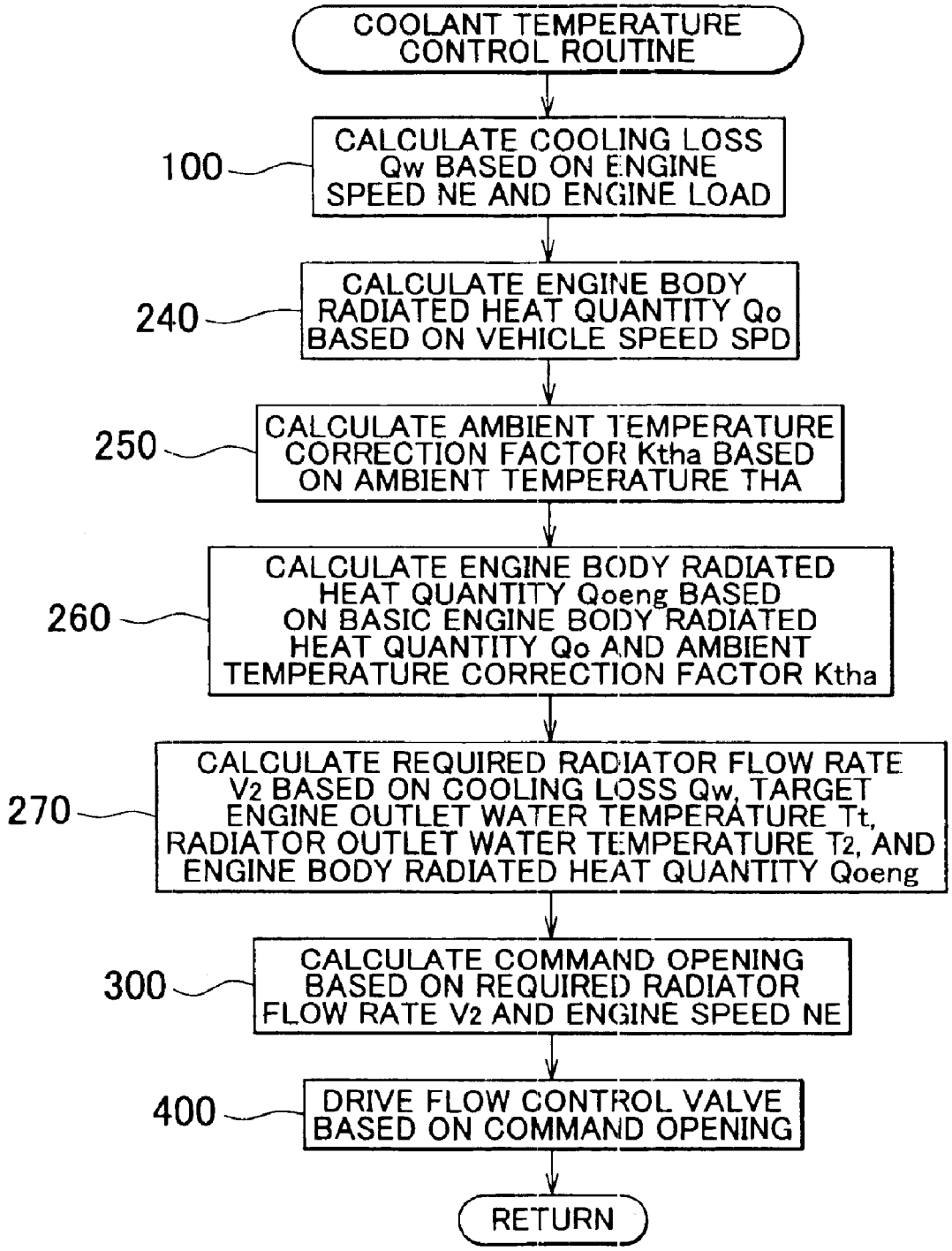
FIG. 10 is a flowchart showing a control routine for controlling the temperature of coolant in a cooling system according to the third embodiment of the invention.

In the following, a coolant temperature control routine to be executed by the ECU 35 will be described with reference to the flowchart of FIG. 10. The coolant temperature control routine of this embodiment is different from that of the first embodiment in terms of an operation to calculate the required radiator flow rate V2. Since the other operations of the routine of FIG. 10 are substantially the same as those of the first embodiment, the same step numbers are assigned to these operations, of which no detailed explanation will be provided.

After calculating the cooling loss Qw in step S100, the ECU 35 calculates an engine body radiated heat quantity Qoeng, which is the quantity of heat radiated from the engine body 12, in steps S240–S260. Initially, in step S240, the basic engine body radiated heat quantity Qo is calculated with reference to, for example, a map shown in FIG. 8, which preliminarily defines a relationship between the vehicle speed SPD and the basic engine body radiated heat quantity Qo.

Here, it is to be noted that the quantity of heat radiated from the engine body 12 increases as a temperature difference between the temperature of the engine body 12 and the ambient temperature increases. Also, the radiated heat quantity increases as a total surface area of high-temperature portions of the engine body 12 increases.

In the meantime, as the running speed of the vehicle (vehicle speed SPD) increases, the air having a large temperature difference from the engine body 12 is more likely to constantly exist around the engine body 12. Accordingly, the quantity of heat radiated from the engine body 12 is relatively small when the vehicle speed is relatively low, and increases as the vehicle speed increases.

Figure 8:
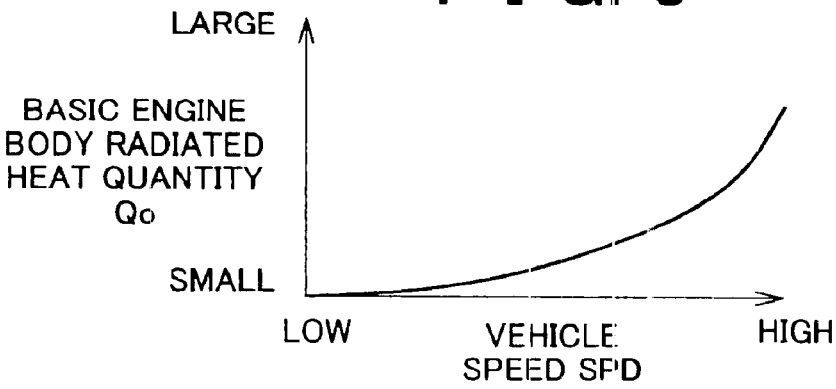
FIG. 8 is a schematic view showing a map used for determination of the basic quantity of heat radiated from an engine body.

In view of the above facts, the basic engine body radiated heat quantity Qo is set to a smaller value with a reduction in the vehicle speed SPD, and is set to a larger value with an increase in the vehicle speed SPD, as is understood from the map of FIG. 8. Thus, the ECU 35 determines the basic engine body radiated heat quantity Qo corresponding to the vehicle speed SPD measured by the vehicle speed sensor 51, from the map of FIG. 8.

Figure 9:
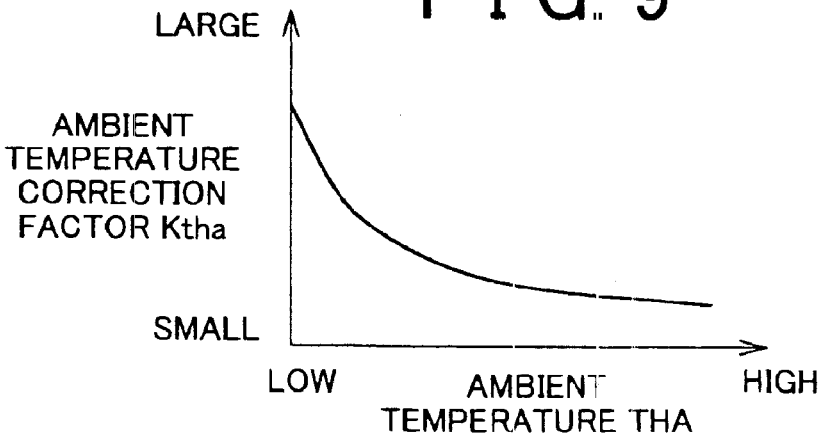
FIG. 9 is a schematic view showing a map used for determination of the ambient temperature correction factor.

Subsequently, an ambient temperature correction factor Ktha is calculated in step S250 with reference to, for example, a map as shown in FIG. 9, which defines a relationship between the ambient temperature THA and the ambient temperature correction factor Ktha.

As described above, the quantity of heat radiated from the engine body 12 increases as a difference between the temperature of the engine body 12 and the ambient temperature increases. If the ambient temperature THA is low, therefore, the difference between the temperature of the engine body 12 and the ambient temperature increases, resulting in an increase of the radiated heat quantity. If the ambient temperature THA is high, on the other hand, the temperature difference as described above is reduced, resulting in a reduction of the radiated heat quantity.

In view of the above facts, the ambient temperature correction factor Ktha is set to a larger value with a reduction in the ambient temperature THA, and is set to a smaller value with an increase in the ambient temperature THA, as shown in FIG. 9. Thus, the ECU 35 determines the ambient temperature correction factor Ktha corresponding to the ambient temperature THA detected by the ambient temperature sensor 52, from the map of FIG. 9 by way of example.

In the next step S270, the required radiator flow rate V2 is calculated according to the following expression (1b), based on the coefficient C, target engine outlet water temperature Tt, radiator outlet water temperature T2, cooling loss Qw, and the engine body radiated heat quantity Qoeng.

$$V2=(Qw-Qoeng)/\{C\cdot(Tt-T2)\} \quad (1b)$$

In the above-described expression (1b), the definitions of C, Tt, T2 and Qw are the same as those of the expression (1) as described above.

After step S270 is executed, steps S300 and S400 are executed in the same manner as in the flowchart of FIG. 2, and the coolant temperature control routine of FIG. 10 is terminated.

The third embodiment as described above in detail provides the following effects in addition to the effects (a) through (d) as described above.

(g) The cooling loss Qw of the engine body 12 is supposed to vary with the quantity of heat radiated from the engine body 12 (i.e., engine body radiated heat quantity Qoeng), in addition to the engine speed NE and the engine load. Here, the engine body radiated heat quantity Qoeng is significantly influenced by the vehicle speed SPD. Also, the engine body radiated heat quantity Qoeng is influenced by the ambient temperature THA though the degree of the influence is not so great as that of the influence by the vehicle speed SPD. If the influences of the vehicle speed SPD and the ambient temperature THA are large, the engine outlet water temperature To is slowly controlled to a target value (i.e., target engine outlet water temperature Tt) with a reduced accuracy unless the engine body radiated heat quantity Qoeng is taken into consideration, which may result in an increased degree of overshoot or undershoot in the coolant temperature control. To avoid or suppress the increases in the degree of overshoot or undershoot, the target engine outlet water temperature Tt may need to be lowered in order to ensure normal operations of respective components of the engine body 12 and others in view of the heat resistance thereof. If the target engine outlet water temperature Tt is lowered, however, the engine outlet water temperature To is lowered, which may result in increased friction in the engine 11 and the automatic transmission, and reduced fuel efficiency (or increased fuel consumption).

In the third embodiment of the invention, therefore, the basic engine body radiated heat quantity Qo is determined (in step S240) based on the vehicle speed SPD, and the ambient temperature correction factor Ktha is determined (in step S250) based on the ambient temperature THA. Then, the engine body radiated heat quantity Qoeng is determined (in step S260) according to the above expression (3), based on the basic engine body radiated heat quantity Qo and the ambient temperature correction coefficient Ktha, and the required radiator flow rate V2 is calculated (in step S270) so that it reflects the engine body radiated heat quantity Qoeng.

Accordingly, the engine outlet water temperature To is smoothly controlled to the target engine outlet water temperature Tt at an increased speed with an improved accuracy even if the engine body radiated heat quantity Qoeng changes. Namely, the degrees of the overshoot and the undershoot in the coolant temperature control can be reduced, and therefore the target engine outlet water temperature Tt need not be lowered in view of the heat resistance of the components of the engine body 12 and others. Consequently, the friction in the engine 11 and the automatic transmission will not be increased due to the otherwise possible reduction of the target engine outlet temperature Tt, and the fuel consumption will not be increased due to the otherwise possible friction increases.

(h) The engine body radiated heat quantity Qoeng is calculated based on the vehicle speed SPD and the ambient temperature THA in steps 240–260. Thus, the engine body radiated heat quantity Qoeng can be determined with improved accuracy, by using the vehicle speed SPD and the ambient temperature THA that are supposed to have influences on the quantity of heat radiated from the engine body 12. Also, since the engine body radiated heat quantity Qoeng is calculation based on both of the vehicle speed SPD and the ambient temperature THA, the accuracy of the calculation is improved as compared with the case where the heat quantity Qoeng is calculated solely based on one (for example, the vehicle speed) of the vehicle speed SPD and the ambient temperature THA.

While the first, second and third embodiments of the invention have been described above, the invention may be otherwise embodied, as in the following examples.

(1) The target coolant temperature may be calculated in a manner different from that of the illustrated embodiments. For example, the target coolant temperature may be calculated based on (a) a combination of the basic fuel injection quantity and the engine speed, (b) a combination of the throttle opening and the coolant temperature, or (c) a combination of the intake pressure and the coolant temperature, as disclosed in Japanese Laid-open Patent Publication No. 5-179948.

(2) The invention may be applied to a cooling system in which the flow rate of coolant passing through the radiator is controlled by an electric water pump, in place of the water pump 24 driven by the engine 11 and the flow control valve 26 as employed in the cooling systems of the illustrated embodiments.

As one method of controlling the opening of the electric water pump, a command opening may be directly determined based on, for example, the operating state of the engine 11, and the opening of the water pump may be controlled in accordance with the command opening. In this case, however, the command opening cannot be determined unless a flow property of the electric water pump is specified.

In the modified embodiment (2), the required radiator flow rate V2 corresponding to the radiator outlet water temperature T2 is determined, and the command opening of the electric water pump is determined from the required radiator flow rate V2, in the same manner as in the illustrated embodiments. In this manner, the command opening can be obtained by using the required radiator flow rate V2 even if the flow property is not specified.

(3) In the first embodiment, the cooling loss Qw may be determined based on only one of the engine speed NE and the engine load (or engine load factor).

(4) In the third embodiment, the engine body radiated heat quantity Qoeng may be determined based on only one of the vehicle speed SPD and the ambient temperature THA. For example, the basic engine body radiated heat quantity Qo may be used as it is as the engine body radiated heat quantity Qoeng without being multiplied by the ambient temperature correction factor Ktha.

(5) The second embodiment and the third embodiment of the invention may be combined together. Namely, the received/radiated heat quantity Qetc and the engine body radiated heat quantity Qoeng may be reflected in the calculation of the required radiator flow rate V2. More specifically, the required radiator flow rate V2 may be calculated according to the following expression (1c).

$$V2=(Qw-Qetc-Qoeng)/\{C\cdot(Tt-T2)\} \quad (1c)$$

In this manner, the engine outlet water temperature To is further smoothly controlled to the target engine outlet water temperature Tt with further improved accuracy even if the received/radiated heat quantity Qetc of the heat receiving/radiating circuits and the engine body radiated heat quantity Qoeng change. Consequently, the degrees of the overshoot and undershoot in the coolant temperature control can be reduced, and the otherwise possible deterioration of the fuel efficiency can be further suppressed.

(6) With regard to one or more of the heat receiving/radiating circuits of the second embodiment, which receive(s) or radiate(s) a particularly large quantity of heat, for example, with regard to the heater circuit 36, hydraulic oil warmer circuit 39 and the hot air intake circuit 40, the received/radiated heat quantity may be measured or corrected in the manner as described below, without using the junction water temperature sensor 49.

With regard to the heater circuit 36, for example, the wind speed is measured in the vicinity of the heater core 41 during running of the vehicle, and the temperatures are measured on the upstream and downstream sides of the heater core 41. Then, the quantity of heat radiated from the heater circuit 36 is calculated from a difference between the upstream-side temperature and the downstream-side temperature of the heater core 41 and the wind speed.

With regard to the hydraulic oil warmer circuit 39, the basic radiated heat quantity is determined from a difference between the temperature of a coolant flowing through the circuit 39 and the temperature of the hydraulic oil. Then, the quantity of heat received or radiated by the hydraulic oil warmer circuit 39 is calculated by multiplying the basic radiated heat quantity by a correction factor which depends upon the flow rate of the coolant passing through the hydraulic oil warmer 47.

With regard to the hot air intake circuit 40, the radiated heat quantity is calculated based on the temperatures on the upstream side and downstream side of the heater core located in the vicinity of the air cleaner 14, and the quantity of intake air flowing through the intake passage 13.

Subsequently, the received/radiated heat quantity Qetc is obtained by adding the received/radiated heat quantities obtained as described above, and is used in the above-indicated expression (1a) for calculating the required radiator flow rate V2.

(7) In the third embodiment, the temperature of the intake air may be used as a substitute value of the ambient temperature THA measured by the ambient temperature sensor 52.

While the invention has been described in detail with reference to exemplary embodiments thereof, it is to be understood that the invention is not limited to the exemplary embodiments or constructions, but may be otherwise embodied with various changes, modifications or improvements, without departing from the scope of the invention.

What is claimed is:

1. A cooling system for an internal combustion engine, including a radiator provided in a coolant circulation path of the internal combustion engine, and an actuator that controls a flow rate of a coolant that passes through the radiator, wherein the actuator is controlled so that a coolant temperature of the internal combustion engine becomes substantially equal to a target coolant temperature, comprising:

a calculating unit that calculates a cooling loss as a quantity of heat removed from the internal combustion engine and received by the coolant, based on an operating state of the internal combustion engine, and calculates a required radiator flow rate, based on the cooling loss, the target coolant temperature, and a temperature of the coolant that has passed through the radiator, the required radiator flow rate representing a quantity of the coolant required to pass through the radiator so as to make the coolant temperature substantially equal to the target coolant temperature; and a control unit that controls the actuator based on the required radiator flow rate obtained by the calculating unit, wherein the calculating unit further calculates a received/radiated heat quantity of at least one heat receiving/radiating circuit that is provided in the coolant circulation path and bypasses the radiator, and calculates the required radiator flow rate based on the received/radiated heat quantity, the cooling loss, the target coolant temperature and the temperature of the coolant that has passed through the radiator; and wherein the at least one heat receiving/radiating circuit comprises a plurality of heat receiving/radiating circuits, and wherein the calculating unit calculates the received/radiated heat quantity of the heat receiving/radiating circuits based on a junction flow rate measured at a meeting portion of the heat receiving/radiating circuits, a junction coolant temperature measured at the meeting portion, and the coolant temperature of the internal combustion engine.

2. The cooling system according to claim 1, wherein the operating state of the internal combustion engine used for calculating the cooling loss includes at least one of a speed of revolution of the internal combustion engine and an engine load.

3. The cooling system according to claim 1, wherein the control unit calculates a command opening based on the required radiator flow rate obtained by the calculating unit and the operating state of the internal combustion engine, and controls an opening of the actuator according to the command opening.

4. The cooling system according to claim 1, wherein the operating state of the internal combustion engine used for calculating the cooling loss includes at least one of a speed of revolution of the internal combustion engine and an engine load.

5. The cooling system according to claim 1, wherein the control unit calculates a command opening based on the required radiator flow rate obtained by the calculating unit and the operating state of the internal combustion engine, and controls an opening of the actuator according to the command opening.

6. The cooling system according to claim 1, wherein the calculating unit calculates the junction flow rate based on a current opening of the actuator and the operating state of the internal combustion engine.

7. The cooling system according to claim 1, wherein the calculating unit further calculates a quantity of heat radiated from a main body of the internal combustion engine, and calculates the required radiator flow rate based on the quantity of heat radiated from the engine body, the received/radiated heat quantity, the cooling loss, the target coolant temperature and the temperature of the coolant that has passed through the radiator.

8. The cooling system according to claim 7, wherein the operating state of the internal combustion engine used for calculating the cooling loss includes at least one of a speed of revolution of the internal combustion engine and an engine load.

9. The cooling system according to claim 7, wherein the control unit calculates a command opening based on the required radiator flow rate obtained by the calculating unit and the operating state of the internal combustion engine, and controls an opening of the actuator according to the command opening.

10. A cooling system for an internal combustion engine, including a radiator provided in a coolant circulation path of the internal combustion engine, and an actuator that controls a flow rate of a coolant that passes through the radiator, wherein the actuator is controlled so that a coolant temperature of the internal combustion engine becomes substantially equal to a target coolant temperature, comprising:

a calculating unit that calculates a cooling loss as a quantity of heat removed from the internal combustion engine and received by the coolant, based on an operating state of the internal combustion engine, and calculates a required radiator flow rate, based on the cooling loss, the target coolant temperature, and a temperature of the coolant that has passed through the radiator, the required radiator flow rate representing a quantity of the coolant required to pass through the radiator so as to make the coolant temperature substantially equal to the target coolant temperature; and a control unit that controls the actuator based on the required radiator flow rate obtained by the calculating unit, wherein the calculating unit further calculates a quantity of heat radiated from a main body of the internal combustion engine, and calculates the required radiator flow rate based on the quantity of heat radiated from the engine body, the cooling loss, the target coolant temperature and the temperature of the coolant that has passed through the radiator, and wherein the internal combustion engine is installed on a vehicle, and the calculating unit calculates the quantity of heat radiated from the engine body based on at least one of a running speed of the vehicle and an ambient temperature around the vehicle.

11. The cooling system according to claim 10, wherein the operating state of the internal combustion engine used for calculating the cooling loss includes at least one of a speed of revolution of the internal combustion engine and an engine load.

12. The cooling system according to claim 10, wherein the control unit calculates a command opening based on the required radiator flow rate obtained by the calculating unit and the operating state of the internal combustion engine, and controls an opening of the actuator according to the command opening.

13. A method of controlling a cooling system for an internal combustion engine, including a radiator provided in a coolant circulation path of the internal combustion engine, and an actuator that controls a flow rate of a coolant that passes through the radiator, wherein the actuator is controlled so that a coolant temperature of the internal combustion engine becomes substantially equal to a target coolant temperature, comprising the steps of:

calculating a cooling loss as a quantity of heat removed from the internal combustion engine and received by the coolant, based on an operating state of the internal combustion engine, and calculating a required radiator flow rate, based on the cooling loss, the target coolant temperature, and a temperature of the coolant that has passed through the radiator, the required radiator flow rate representing a quantity of the coolant required to pass through the radiator so as to make the coolant temperature substantially equal to the target coolant temperature;

controlling the actuator based on the required radiator flow rate;

calculating a received/radiated heat quantity of at least one heat receiving/radiating circuit that is provided in the coolant circulation path and bypasses the radiator; and calculating the required radiator flow rate based on the received/radiated heat quantity, the cooling loss, the target coolant temperature and the temperature of the coolant that has passed through the radiator;

wherein the at least one heat receiving/radiating circuit comprises a plurality of heat receiving/radiating circuits, and wherein the received/radiated heat quantity of the heat receiving/radiating circuits is calculated based on a junction flow rate measured at a meeting portion of the heat receiving/radiating circuits, a junction coolant temperature measured at the meeting portion, and the coolant temperature of the internal combustion engine.

14. The method according to claim 13, wherein the operating state of the internal combustion engine used for calculating the cooling loss includes at least one of a speed of revolution of the internal combustion engine and an engine load.

15. The method according to claim 13, further comprising the steps of:

calculating a command opening based on the required radiator flow rate and the operating state of the internal combustion engine; and controlling an opening of the actuator according to the command opening.

16. The method according to claim 13, wherein the operating state of the internal combustion engine used for calculating the cooling loss includes at least one of a speed of revolution of the internal combustion engine and an engine load.

17. The method according to claim 13, further comprising the steps of:

calculating a command opening based on the required radiator flow rate and the operating state of the internal combustion engine; and controlling an opening of the actuator according to the command opening.

18. The method according to claim 13, wherein the junction flow rate is calculated based on a current opening of the actuator and the operating state of the internal combustion engine.

19. The method according to claim 13, further comprising the steps of:

calculating a quantity of heat radiated from a main body of the internal combustion engine; and calculating the required radiator flow rate based on the quantity of heat radiated from the engine body, the received/radiated heat quantity, the cooling loss, the target coolant temperature and the temperature of the coolant that has passed through the radiator.

20. The method according to claim 19, wherein the operating state of the internal combustion engine used for calculating the cooling loss includes at least one of a speed of revolution of the internal combustion engine and an engine load.

21. The method according to claim 19, further comprising the steps of:

calculating a command opening based on the required radiator flow rate and the operating state of the internal combustion engine; and controlling an opening of the actuator according to the command opening.

22. A method of controlling a cooling system for an internal combustion engine, including a radiator provided in a coolant circulation oath of the internal combustion engine, and an actuator that controls a flow rate of a coolant that passes through the radiator, wherein the actuator is controlled so that a coolant temperature of the internal combustion engine becomes substantially equal to a target coolant temperature, comprising the steps of:

calculating a cooling loss as a quantity of heat removed from the internal combustion engine and received by the coolant, based on an operating state of the internal combustion engine, and calculating a required radiator flow rate, based on the cooling loss, the target coolant temperature, and a temperature of the coolant that has passed through the radiator, the required radiator flow rate representing a quantity of the coolant required to pass through the radiator so as to make the coolant temperature substantially equal to the target coolant temperature;

controlling the actuator based on the required radiator flow rate;

calculating a quantity of heat radiated from a main body of the internal combustion engine; and calculating the required radiator flow rate based on the quantity of heat radiated from the engine body, the cooling loss, the target coolant temperature and the temperature of the coolant that has passed through the radiator, wherein the internal combustion engine is installed on a vehicle, and the quantity of heat radiated from the engine body is calculated based on at least one of a running speed of the vehicle and an ambient temperature around the vehicle.

23. The method according to claim 22, wherein the operating state of the internal combustion engine used for calculating the cooling loss includes at least one of a speed of revolution of the internal combustion engine and an engine load.

24. The method according to claim 22, further comprising the steps of:

calculating a command opening based on the required radiator flow rate and the operating state of the internal combustion engine; and controlling an opening of the actuator according to the command opening.

* * * * *